United States Patent [19]

Lasinsky et al.

[11] Patent Number: 4,948,646

[45] Date of Patent: Aug. 14, 1990

[54] MODIFIED SEAM FELT

[75] Inventors: Ellen Lasinsky, Dedham, Mass.; Dirk M. Baars, East Windsor, Conn.

[73] Assignee: Albany International Corp., Albany, N.Y.

[21] Appl. No.: 432,799

[22] Filed: Nov. 7, 1989

[30] Foreign Application Priority Data

Nov. 7, 1988 [GB] United Kingdom ..... 8826008

[51] Int. Cl.[5] ..... B32B 5/02

[52] U.S. Cl. ..... 428/60; 428/234; 428/58; 28/141

[58] Field of Search ..... 428/60, 234; 28/141

[56] References Cited

U.S. PATENT DOCUMENTS 4,601,785 7/1986 Lilja et al. ..... 28/141

4,683,624 8/1987 Dufour ..... 28/141

*Primary Examiner*—Alexander S. Thomas

*Attorney, Agent, or Firm*—Ostrolenk, Faber, Gerb & Soffen

[57] ABSTRACT

The invention provides a press felt seam comprising a first felt end and a second felt end interconnected by hinge means wherein the soft cover layer on the first felt end is configured to provide a flap element overlaying said hinge means, and the soft cover layer on the second end is configured to support said flap. The surface of said flap contiguous the hinge means is provided with a resilient support material to impart to the seam area a compression recovered thickness substantially equal to or slightly greater than the rest of the felt.

8 Claims, No Drawings

MODIFIED SEAM FELT

This invention relates to seamed press felts and has particular reference to a seamed press felt modified to reduce or substantially eliminate marking of a paper sheet thereby.

In a paper making machine when a newly formed sheet leaves the forming section, it has a moisture content typically between 70 and 80% depending upon the type of paper making machine employed. On leaving the forming section, the thus formed sheet is passed through the press section where the sheet is advanced on a press felt through the press nip between press rolls where further water is expressed from the sheet. The press section may include several press nips in order to remove the maximum amount of remaining water in this section.

A typical press felt comprises a soft part which is positioned juxaposed the paper web and serves to protect the latter and an incompressible part designed to receive water from the paper sheet and carry it away in the press nip. The essential features of a press felt are that it should be substantially uniform in properties to prevent any kind of marking of the paper.

It will be appreciated that the difficulty arises in jointing press felts since either the felts are made in a tubular fashion or felts are made in longitudinal lengths and then need to be joined. Hitherto, it has been felt that only felts in which the seams are woven have been acceptable, since this tends to overcome the substantial discontinuity occasioned by other types of press felt joints. Loop seams in press felts have been proposed in, for example, in U.S. Pat. Nos. 2,883,734 and 2,907,093, but because of the nature of the loops, it is self-evident that in conventionally woven single layer felts where little protection is available for seam loops, marking of the paper web is almost inevitable.

To overcome the marking it has been proposed that the soft cover or batt layer is configured to provide a flap which overlays the loop hinge in order to protect the paper web from direct contact with the loop seam of the felt.

This suffers from the disadvantage that there is still a discontinuity in properties and the compression characteristics of the soft cover layer of the press felt with a result that some marking of the paper web still occurs.

We have made previous proposals in our U.S. Pat. No. 4,601,785 and 4,683,624 to deal with this problem of marking. These proposals, while helping substantially to mitigate the marking which occurs, have not completely provided a solution. It is, therefore, an object of the present invention to provide a still further improved seam felt which reduces or substantially eliminates marking.

According to the present invention there is provided a press felt seam comprising a first felt end and a second felt end interconnected by hinge means wherein the soft cover layer on the first felt end is configured to provide a flap element overlaying said hinge means, and the soft cover layer on the second end is configured to support said flap, characterised in that the surface of said flap contiguous said hinge means is provided with a resilient support material to impart to the seam area a compression recovered thickness substantially equal to or slightly greater than the rest of the felt.

The hinge means may be a looped seam of a type known per se . The flap may extend from a forward first end in rearwardly therefrom when considered in the direction of travel. The flap reduces in thickness in a rearward direction and the second end of the seam joint may be chamfered to accommodate said flap.

The amount of resilient material is dependent on the properties of the material and should be sufficient to impart to the flap a compression which is equal to or slightly greater than that for the body of the felt as a whole.

In a typical embodiment of the present invention where the felt comprises a base layer having a batt needled thereto, the batt layer is cut behind the seam in the intended direction of travel of the felt down to the level of the woven base and then loosened off the woven base in a zone extending along either side of the intended seam. The seam connector or pintle wire is then removed and the felt is mounted on a press in the press section of a paper-making machine whereupon the felt ends are again joined together by re-introduction of the pintle wire or connector through the loop seam. An effective amount of resilient or filling material is applied over the seam and/or under the flap.

The resilient material may be in any one of a number of forms and may include monofilaments, multifilaments (continuous or spun yarns), woven and non-woven fabrics. These materials may be held in place by an appropriate adhesive or by other physical means. The filling material may, for example, be held in place by an adhesive such as polyurethane adhesive or a low melt polyamide adhesive. Low melt polyamide thread may also be employed which could be used to bind the filling material to the batt followed by suitable heating. In an alternative embodiment of the invention, the filling material may comprise a low melt polyamide fibre such as a Grilon K-140 or a T100 polyamide fibre such as that available from E.I. Du Pont de Nemours & Co., or any combination thereof.

This concept has been demonstrated in a number of experiments utilizing coarse multifilament (100–150 dpf) polyamide yarns, plied polyamide monofilaments, and fused polyamide batts as the filling materials. These filling materials were bonded between the flap and seam loops by polyamide or polyurethane adhesive or by sewing down the flap with thread. An additional benefit of these methods is that the batt flap is secured, which potentially reduces flap wear on the paper machine. Samples prepared by the above mentioned methods were conditioned by subjecting them to 500 compression cycles at 1000 psi and subsequently evaluated for sheet marking on the Albany International Research Co. dynamic press nip simulator using 100 g/m$^2$ bleached softwood kraft hard sheets. Each of the "filled" felt samples yielded greatly reduced sheet marking when compared to the as manufactured, unfilled seamed felt.

Following is a description by way of example only of methods of carrying the invention into effect.

COMPARATIVE EXAMPLE 1

A four inch diameter circular sample of Albany International OMS-2000 seamed press felt was used as a control. The sample was cut such that the edge of the seam felt formed a diameter of the circle. This sample was conditioned by transverse compression of the felt to 1000 psi for 500 cycles such that it reached an equilibrium thickness. The felt was then used in a dynamic press nip simulator (DPNS) to test for tendency to mark paper sheets. Paper used in the test was 100 gm/sq m bleached softwood kraft with an ingoing consistency of 25%. Ingoing moisture ratio for the felt was 0.5. The felt sample was pressed against a paper sheet sample at 450 psi for 15 milliseconds to simulate a pressure pulse on a paper machine press section. The paper sheet was then removed and examined in the wet and later in the dry state. The pressed paper sheet was found to have a distinct shadow mark in both the wet and dry states when viewed with transmitted light. This mark was positioned in the paper sheet along the line of contact with the seam area of the felt.

EXAMPLE 1

A second four inch diameter sample was taken from the same OMS-2000 seamed press felt used in Comparative Example 1. This sample was pretreated by the insertion of polyamide bulk continuous filament yarn which had been melt spun, drawn and texturized in a stuffer box crimper. The yarn consisted of 30 filaments at a denier of 100–150 per filament. A strand of the yarn was twisted a half turn and laid between the flap and the seam loops. A bead of TC118 polyurethane adhesive was used to hold the yarn in place. A second bead of the adhesive was used to seal down the flap. The flap was sealed down with pressure for several minutes until the adhesive cured. This filled felt sample was then tested on the DPNS at the same test conditions used for the control. The paper sheet was examined and found to have reduced marking in the wet state and to be free of marks in the dry state.

EXAMPLE 2

The bulk continuous filament yarn used in Example 1 was precoated with Bostik low melt polyamide adhesive from a 16% solution of 50/50 methanol/methylene chloride. Add-on of the melt adhesive was 15%. The coated yarn was laid in the seam area of an OMS-2000 seamed felt sample, the flap was closed over the yarn and a steam iron was used to melt the adhesive. The filled sample was found to leave no paper sheet mark in DPNS testing at the conditions of Example 1.

EXAMPLE 3

The bulk continuous filament polyamide yarn used in Example 1 was laid in the seam area of an OMS-2000 felt sample. The flap was closed over the yarn and was sewn down with low melt polyamide fusible thread. A steam iron was used to melt the sewing thread into the felt. DPNS testing of the felt sample gave no paper sheet mark using the test conditions of Example 1.

EXAMPLE 4

A 1/16 inch square strip of fused batt (10% Grilon K-140 low melt polyamide fibres, 90% Dupont T100 polyamide fibres) was laid between the flap and seam loops of a joined OMS-2000 press felt sample. The flap was closed over the strip of fused felt and an iron was used on the face of the felt to hold it in place. The sample was tested on the DPNS and found to give no seam marking.

We claim:

1. A press felt seam comprising a first felt end and a second felt end interconnected by hinge means wherein the soft cover layer on the first felt end is configured to provide a flap element overlaying said hinge means, and the soft cover layer on the second end is configured to support said flap, characterised in that the surface of said flap contiguous said hinge means is provided with a resilient support material to impart to the seam area a compression recovered thickness substantially equal to or slightly greater than the rest of the felt.

2. A press felt seam according to claim 1 in which the hinge means is a looped seam.

3. A press felt seam according to claim 1 in which the flap extends in a rearwardly direction from a forward first end when considered in the direction of travel.

4. A press felt seam according to claim 3 in which the flap reduces in thickness in the rearward direction and a second end of the seam joint is chamfered to accommodate said flap.

5. A press felt seam according to claim 1 in which the amount of resilient material is dependent on the properties of the material and is selected to be sufficient to impart to the flap a compression which is equal to or slightly greater than that for the body of the felt as a whole.

6. A press felt seam as claimed in claim 1 in which the resilient material includes monofilaments, continuous or spun yarn multifilaments, woven and non-woven fabrics, either singly or in combination.

7. A press felt seam as claimed in claim 1 in which the material is held in place by a polyurethane or low melt polyamide adhesive.

8. A press felt material as claimed in claim 1 in which the resilient material comprises a low melt polyamide fabric.

* * * * *